United States Patent [19]

Delisle, Jr.

[11] Patent Number: 4,574,663

[45] Date of Patent: Mar. 11, 1986

[54] CORK EXTRACTOR

[76] Inventor: Bernard Delisle, Jr., P.O. Box 1185, Edgartown, Mass. 02539

[21] Appl. No.: 606,384

[22] Filed: May 2, 1984

[51] Int. Cl.[4] ..... B67B 7/00

[52] U.S. Cl. ..... 81/3.48; 81/3.09

[58] Field of Search ..... 81/3.48, 3.49, 3.1 A; 7/155, 156

[56] References Cited

U.S. PATENT DOCUMENTS 4,437,359 3/1984 Dejoux et al. ..... 81/3.1 A X

FOREIGN PATENT DOCUMENTS 580745 9/1924 France ..... 81/3.49

246954 4/1945 Switzerland ..... 81/3.48

2017660 10/1979 United Kingdom ..... 81/3.48

*Primary Examiner*—James G. Smith

*Attorney, Agent, or Firm*—Barlow & Barlow, Ltd.

[57] ABSTRACT

An improved cork extractor is disclosed which has a corkscrew secured to a body member in a pivoting relationship thereto, with a fulcrum member pivoted to one end of the body member to co-act with the corkscrew. The fulcrum member is also provided with a knife portion for cutting the seals about bottle tops, and a cover is slidably arranged on the body member to cover the corkscrew when the same is pivoted into parallel relationship with the body member to make a convenient case for the cork extractor.

4 Claims, 6 Drawing Figures

CORK EXTRACTOR

BACKGROUND OF THE INVENTION

Cork extractors have been known for some time and have generally taken a form where they provide a fulcrum device that rests on the lip of a bottle after the corkscrew has entered the cork so that a leverage is formed to enable the cork to be readily started from the bottle neck. The general form of such devices consists of a pair of parallel plates in between which the corkscrew is pivoted, the corkscrew resting against the general longitudinal extent of the plates. In this form a corkscrew is never fully protected, and its sharp point can easily become entangled with one's clothing when the same is carried, for example, in a pocket. This can be readily seen by referring to a patent such as the Garimaldi patent, U.S. Pat. No. 786,492.

SUMMARY OF THE INVENTION

The instant invention overcomes the problem wherein parts of the corkscrew protrude and engage one's clothing, and provides a case into which the corkscrew may be retained. The improved cork extractor consists essentially of a body member in the form of a bar, to which a corkscrew is pivoted. The corkscrew is provided with a plurality of flat portions which may be engaged by a leaf spring to essentially hold the corkscrew in adjusted position relative to the body member. Pivoted to one end of the body member adjacent the corkscrew is a U-shaped cover in the form of a fulcrum member, which carries not only an abutting surface against which the rim of the bottle may be engaged, but also a knife edge surface which can be used for cutting the seal about the top of a bottle. A slidable cover member slides about the other end of the body member and serves to increase the lever arm of the body member, as well as having an opening into which the corkscrew when folded parallel to the body member, may be encased.

DETAILED DESCRIPTION OF THE PREFERRED EMBODIMENT

Figure 1:
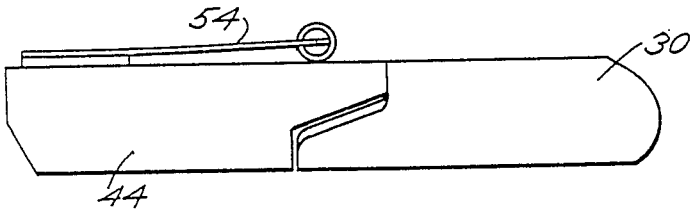
FIG. 1 is a side elevational view showing the cork extractor in closed position.

Referring now to the drawings, a cork extractor comprises a body member 10 which is substantially square in cross section, and is provided with a recess portion 12 into which a flat leaf spring 14 is fitted. One end of the body member is provided with a pair of lugs 16 that provide a pivoting point for a fulcrum member, and ears 18 extend from the body member to pivotally mount a corkscrew 20. The corkscrew has a rectangular stem 22 that has flat portions as at 23, 24, for example that surfaces against surfaces against which the same may be engaged by the leaf spring 14. Pivoting of the corkscrew to the ears is about a fastener such as a rivet 25.

Figure 6:
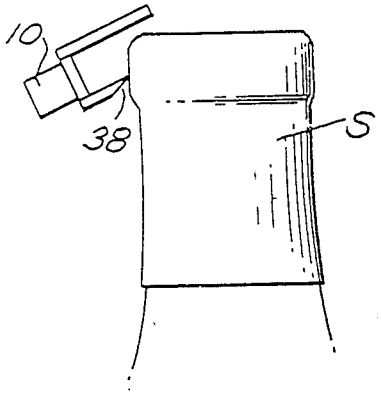
FIG. 6 is a diagrammatic view showing the knife portion of the fulcrum member engaged with the seal of a bottle.
Figure 4:
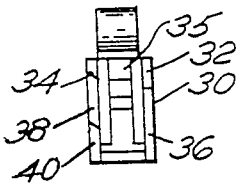
FIG. 4 is an end view taken from the right side of FIG. 3.
Figure 5:
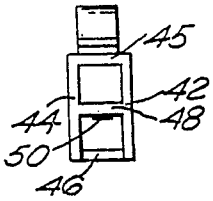
FIG. 5 is an end view taken from the lefthand end of FIG. 3.

A fulcrum member 30 consists essentially of a pair of side plates 32, 34 joined together by a top plate 35. The plate 32 is beveled as at 36, and plate 34 is beveled at 38 and is preferably sharpened to a knife edge. So that the fulcrum can engage the top of the bottle, the plates are each provided with a shoulder as at 40, which is adapted to rest at the top or rim of the bottle. The knife edge formed by the bevel 38 is seen in operation in FIG. 6 about a seal S that covers the cork and the complete top of the bottle, which is conveniently found in most bottles that dispense wine.

Figure 2:
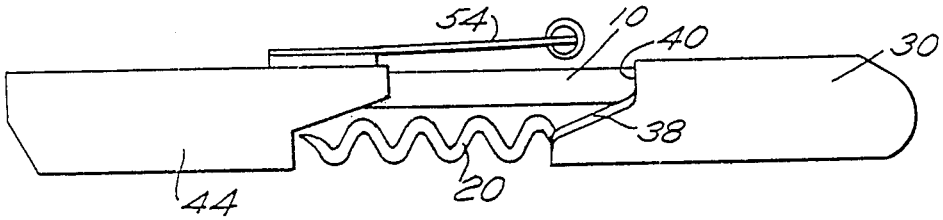
FIG. 2 is a side elevational view showing the cork extractor in partially opened position.
Figure 3:
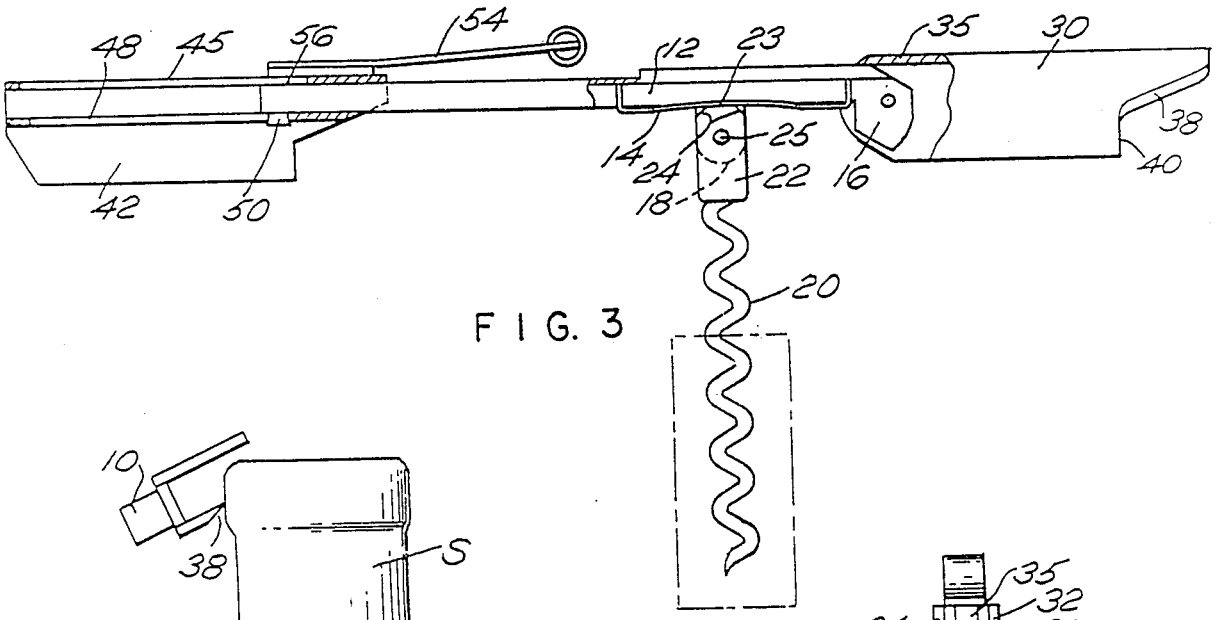
FIG. 3 is a side elevational view partly in section showing a cork extractor in full opened position with the corkscrew engaged in a cork (shown in phantom)

Near the other end of the body member is a slidable cover which essentially has a pair of side plates 42, 44 joined by top and bottom plates 45, 46, and an intermediate plate 48. The body member, as can be seen by referring to FIG. 3, is received between the intermediate plate 48 and the top plate 45 which form a compartment, while the space between the intermediate plate 48 and the bottom plate 46 serves as a receptacle for receiving the corkscrew when in folded position (see FIG. 2). This cover is slidable on the body member which is received in the compartment and will reach its maximum extension by having the intermediate plate 48 engage a stop 50 that protrudes from the body member. For convenience's sake the body member may also be provided with a pocket clip 54 which is fastened to the body member as by riveting or spot welding at 56, a slot 45' being provided in the top wall 45 to allow the top wall to slide about the pocket clip attachment point.

I claim:

1. A cork extractor comprising an elongated body member, a corkscrew pivoted to the body member intermediate the ends thereof, a fulcrum member of U-section hinged to one end of the body member and having a shoulder and a tapered knife portion, a cover telescopically encasing the cork screw and being longitudinally slidable away therefrom and retained on the body member to provide an extended handle.

2. A cork extractor as in claim 1 wherein the body member has a pair of ears, the corkscrew pivoted to the ears and spring means between the body member and the corkscrew resisting movement of the cork screw.

3. A cork extractor as in claim 2 wherein the corkscrew has a rectangular stem with a substantially flat end wall pivoted to the ears, said spring engaging said end wall

4. A cork extractor as in claim 1 wherein a pocket clip is fixed to the cover.

* * * * *